United States Patent [19]

Bachvarov

[11] 4,169,266

[45] Sep. 25, 1979

[54] AERIAL SYSTEM FOR BROADCASTING HAVING A PASSIVE MIDDLE ANTENNA FLANKED BY TWO END-FED ANTENNAS

[75] Inventor: Hristo A. Bachvarov, Sofia, Bulgaria

[73] Assignee: NPP "Teshka Radioelektronika", Sofia, Bulgaria

[21] Appl. No.: 812,730

[22] Filed: Jul. 5, 1977

[51] Int. Cl.[2] ..... H01Q 19/26; H01Q 3/24

[52] U.S. Cl. ..... 343/835; 343/853

[58] Field of Search ..... 343/818, 826, 834, 835, 343/853, 854, 876, 796, 890, 891

[56] References Cited

U.S. PATENT DOCUMENTS

| | | | |
|---|---|---|---|
| 1,740,851 | 12/1929 | Franklin | 343/853 |
| 2,251,997 | 8/1941 | Goldmann | 343/815 |
| 3,175,219 | 3/1965 | Wernick et al. | 343/876 |
| 3,299,429 | 1/1967 | McMullin | 343/796 |

FOREIGN PATENT DOCUMENTS

| | | | |
|---|---|---|---|
| 961705 | 5/1950 | France | 343/853 |

*Primary Examiner*—Eli Lieberman
*Attorney, Agent, or Firm*—Karl F. Ross

[57] ABSTRACT

An antenna system for broadcasting comprises a coplanar array of three vertical aerials spaced a quarter wavelength apart, the middle aerial serving as a passive reflector while the outer two are concurrently energized with currents of equal amplitude and frequency in phase or in phase opposition with each other. The resulting radiation pattern is circular in the first instance; in the second case the pattern is generally hourglass-shaped and bisected by the common plane of the aerials.

4 Claims, 5 Drawing Figures

AERIAL SYSTEM FOR BROADCASTING HAVING A PASSIVE MIDDLE ANTENNA FLANKED BY TWO END-FED ANTENNAS

This invention relates to an aerial system for broadcasting, which can find application in stationary broadcasting stations.

There are known aerial systems for broadcasting, comprising one emitter and one passive reflector. Their emission diagram is oriented in the direction reflector-aerial, while in the opposite direction the emission is minimal. More precisely, their diagram of emission has a shape resembling a cardioid. These aerial systems cannot produce an electromagnetic field of equal intensity in all directions around the system or a maximum intensity at two diametrically opposite locations.

There are also known aerial systems comprising three active radiators, disposed in one line and fed in such a way that the first acts as a reflector, the second as an emitter and the third as a director, and as a result an emission diagram is obtained which is strongly oriented toward the director. Such three-part system cannot provide a circular emission diagram, nor a diagram of figure-eight shape, i.e. with two directions of maximum emission.

There are also known aerial systems comprising two interconnected vertical radiators separated by a distance of $\lambda/4$. If the currents passing through both radiators are in phase, the diagram of emission is an ellipse, and if the currents through the radiators are in opposite phase, the emission diagram is in the shape of a figure eight, composed of two osculating circles, whose axis coincides with the plane of the radiators. With these aerial systems it is not possible to obtain a circular emission diagram, nor a diagram in the shape of an elongated figure eight, and for this reason their effectivity is comparatively low.

It is, therefore, a general object of our present invention to provide an aerial system whose emission diagram, depending on the fed phase differences of the oscillations to its fed radiators, has the shape of a circle or of an elongated figure eight and has a higher effectivity as compared with the aforementioned aerial systems.

This object is achieved pursuant to our invention, by an aerial system comprising two vertical emitters between which there is disposed a passive reflector in their plane which is separated from each of them by a distance of $\lambda/4$.

The two emitters are fed by two separate transmitters, or by one transmitter, with high-frequency currents which are either in phase or in phase opposition and have equal amplitudes.

When the high-frequency currents are in phase, the shape of the emission diagram is almost circular, and when the currents are in phase opposition, the shape is an elongated figure eight. These shapes of the emission diagram are obtained as a result of the vectorial addition of the amplitudes of the electromagnetic fields emitted from the two aerials.

The advantages of the aerial system in accordance with the invention are: when the emission diagram is almost a circle, the intensity of the electromagnetic field at all points of the diagram at equal emitted power is twice that of the electromagnetic field produced by one single vertical radiator with circular emission diagram. At twice the emitted power it produces an electromagnetic field with an intensity at all points of the diagram equal to the maximum intensity of the field produced by the system emitter-reflector. At equal emitted power it produces an electromagnetic field with an intensity at all points of the diagram equal or close to the maximum intensity of the field produced by an aerial system consisting of two interconnected emitters, which has an emission diagram in the shape of an ellipse.

When its emission diagram has the shape of an elongated figure eight, the maximum intensity of the field produced by our antenna system, is much greater than the maximum intensity of the field produced by two connected vertical emitters, which have an emission diagram in the shape of an eight composed of two osculating circles.

The emission diagram of the aerial system can be modified by varying the phase of one of the transmitters without switching off and no returning of the emitters and the reflector is necessary. This operation can also be performed by telecontrol.

The feeding of the emitters by two separate transmitters is more expedient than the use of one twice as powerful transmitter from a viewpoint of operation and reliability. The high effectivity makes the aerial system according to our invention particularly suitable for use in high-power broadcasting stations.

For a better understanding of the invention, reference should be made to the accompanying drawing in which.

Figure 1:
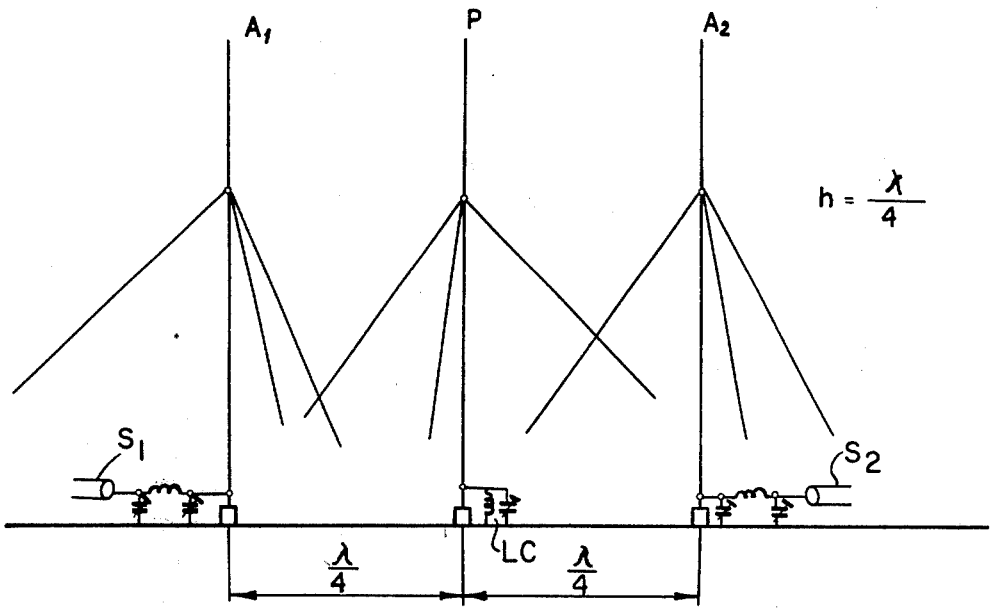
FIG. 1 shows diagrammatically the arrangement of an experimental aerial system for broadcasting, comprising a coplanar array of a central vertical reflector and two opposite vertical emitters a quarter wavelength away.

The experimental aerial system shown in FIG. 1, mounted over ground comprises two end fed emitters $A_1$ and $A_2$, which are metallic pipes of a height equal to $\lambda/2$, and a passive reflector P of the same height, disposed midway between them at a distance of $\lambda/4$ therefrom. The feeding of the emitters $A_1$ and $A_2$ is effected at their base by two transmitters (not shown in the drawing) of equal power and equal frequency via respective supply lines $S_1$, $S_2$. The passive aerial P is shown grounded for direct current by way of a tuned circuit LC.

Figure 2:
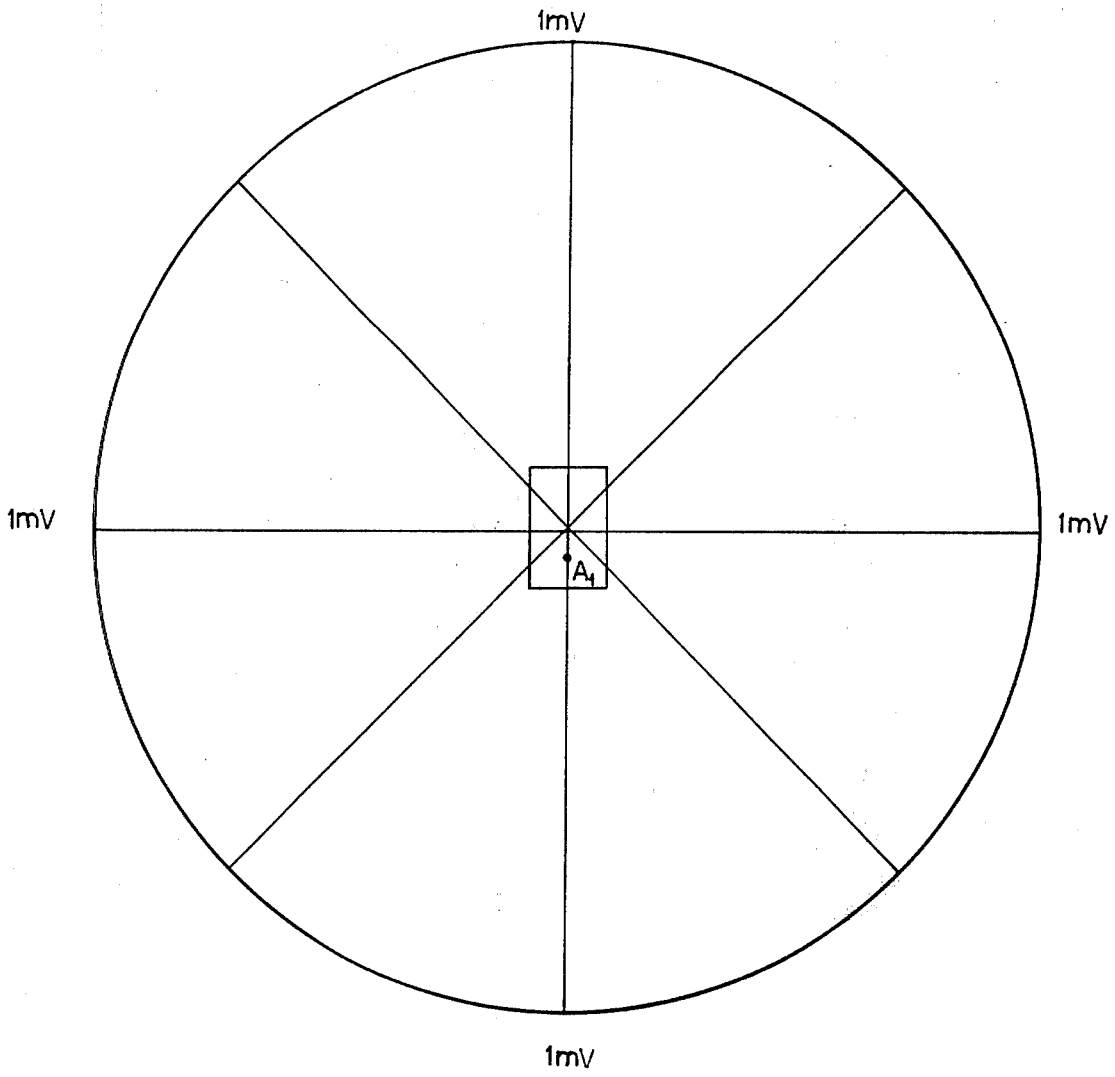
FIG. 2 PRIOR ART
FIG. 2 shows the horizontal emission diagram obtained experimentally from one vertical metallic emitter with a height equal to $\frac{1}{2}\lambda$ and fed at its base.

When only one of the emitters is fed, radiator $A_1$ for example, then a circular emission diagram is obtained. At points equidistant from the emitter there was measured, in a specific instance an intensity of the electromagnetic field equal to 1 mV/m (see FIG. 2). The second emitter $A_2$ and the reflector P are not erected in this case.

Figure 3:
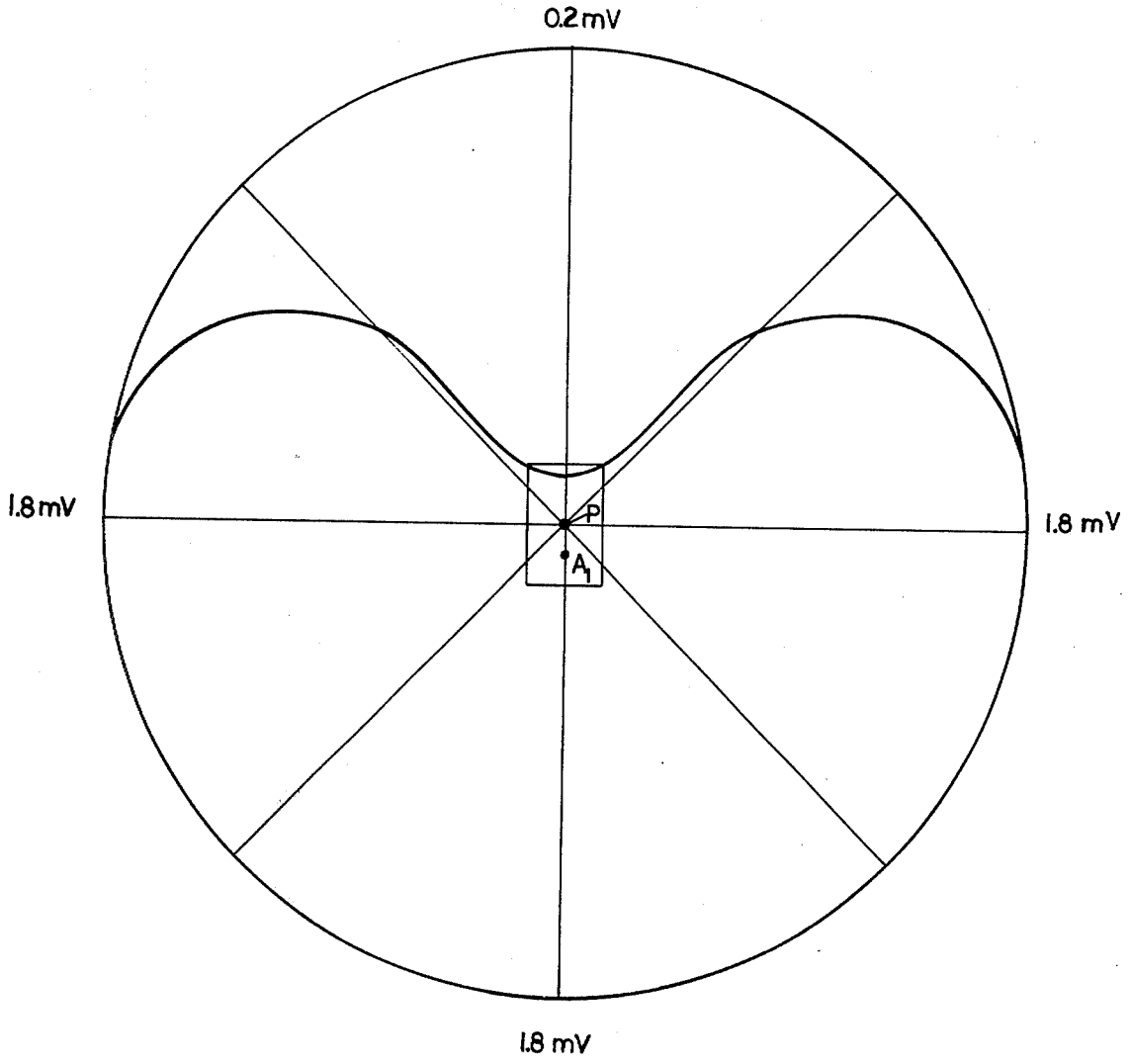
FIG. 3 PRIOR ART
FIG. 3 shows the horizontal emission diagram obtained experimentally from an emitter and a passive reflector, the emitter being the same as in FIG. 2.

When reflector P is erected and emitter $A_1$ is fed with the same power, then an emission diagram in the shape of a cardioid is obtained. At the same points as in the first case there was measured, in the experiment referred to, an intensity of the elctromagnetic field indicated in FIG. 3 with a maximum measured value of 1.8 mV/m.

Figure 4:
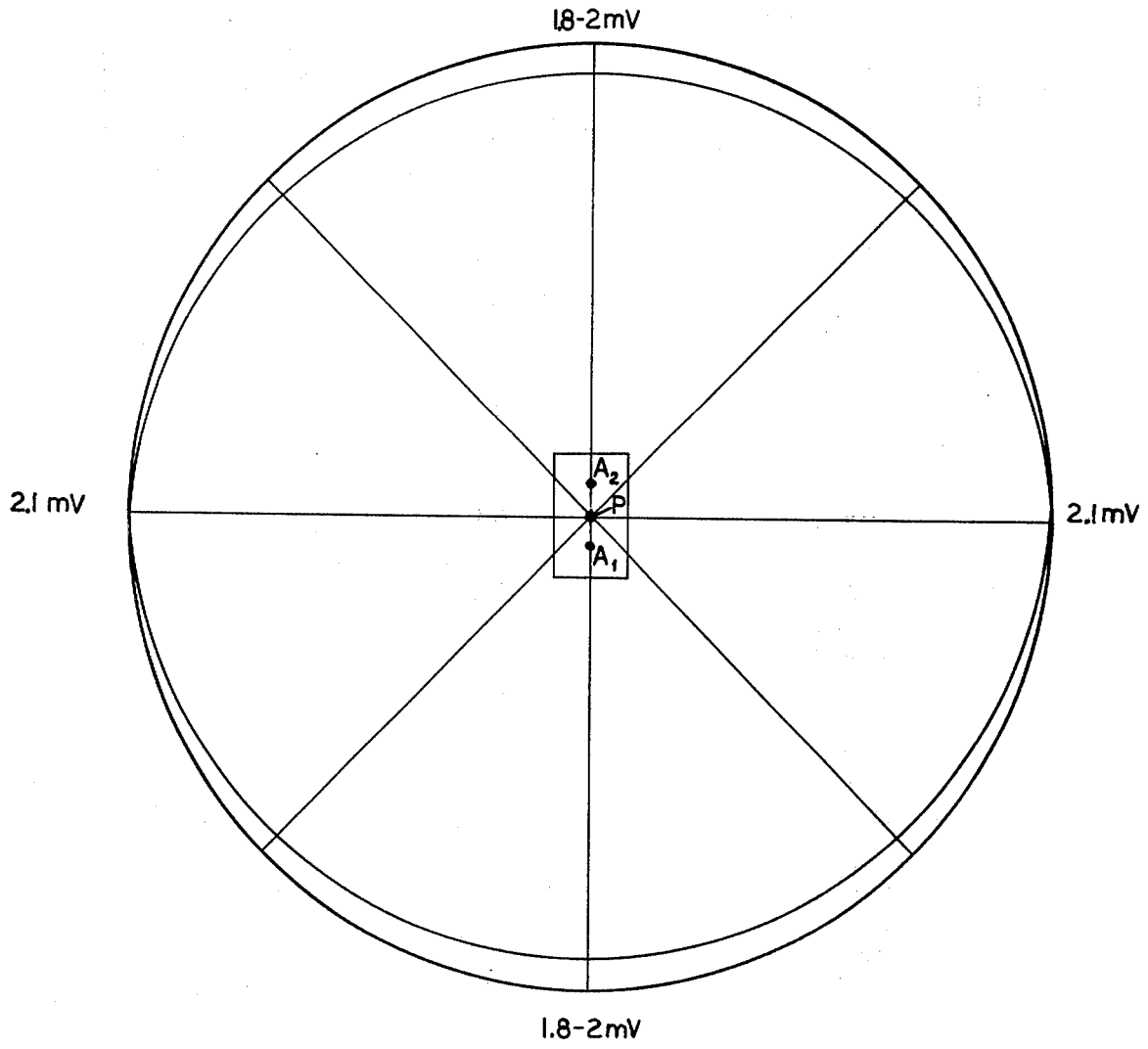
FIG. 4 shows the horizontal emission diagram of the experimental aerial system of FIG. 1 in the case when the currents in the two emitters are in phase.

When the second emitter $A_2$ is also erected and the two emitters are fed in phase by two transmitters with equal power, the obtained emission diagram has the shape of an almost regular circle. There the measured intensity of the electromagnetic field at the same points as in the first and the second cases, shown in FIG. 4, ranged from 1.8 to 2.1 mV/m.

The obtained diagram for the emission and the intensity of the electromagnetic field confirms that the aerial system in accordance with this invention has an almost circular emission diagram and the intensity of its field is greater than that of the field obtained with a single vertical emitter and equal to the maximum field intensity of an aerial system composed only of one emitter and one reflector.

Figure 5:
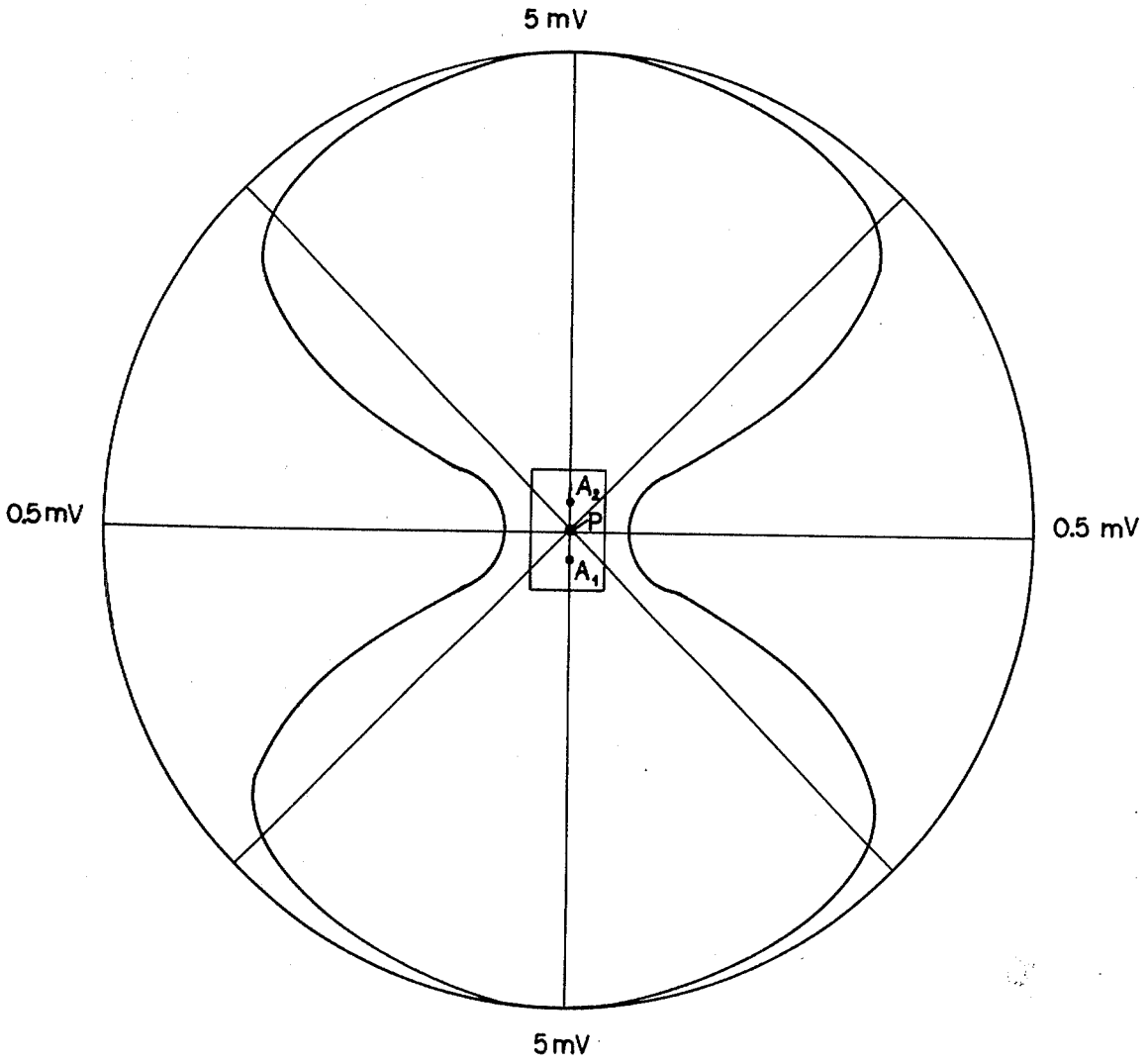
FIG. 5 shows the horizontal emission diagram of the experimental aerial system of FIG. 1 in the case when the currents in the two emitters are 180° out of phase.

When the two emitters $A_1$ and $A_2$ are fed in opposite phase, the emission diagram has the shape of an hourglass or an elongated figure eight as shown in FIG. 5. The measured field intensity had a maximum of 5 mV/m and a minimum of 0.5 mV/m, while in an aerial system composed of two interconnected emitters, excited in opposite phase with an emission diagram in the shape of a figure eight composed of two oscillating circles, the maximum intensity of the field at the same emitted power would be about 2 mV/m.

All of these results, which prove the high effectivity of the disclosed aerial system, can be explained by the vectorial addition in space of the emitted powers and their suitable orientation with respect to the earth surface.

What we claim is:

1. An antenna system for broadcasting, comprising:
   an aerial array consisting of a half-wavelength passive middle aerial flanked by two end-fed half-wavelength radiating outer aerials in a common vertical plane mounted over ground; and
   supply means connected to said outer aerials for energizing same with oscillations of substantially identical frequency and amplitude, each of said outer aerials being separated from said middle aerial by a distance substantially corresponding to a quarter wavelength of said oscillations.

2. An antenna as defined in claim 1 wherein said middle aerial is grounded for direct current through a tuned circuit.

3. An antenna as defined in claim 1 wherein said oscillations are in phase with each other, said aerials emitting a substantially circular radiation pattern.

4. An antenna as defined in claim 1 wherein said oscillations are in phase opposition with each other, said aerials emitting a generally hourglass-shaped radiation pattern bisected by said common vertical plane.

* * * * *